US005484279A

United States Patent [19]

Vonasek

[11] Patent Number: 5,484,279

[45] Date of Patent: Jan. 16, 1996

[54] METHOD AND APPARATUS FOR DISPOSAL OF LANDFILL GAS CONDENSATE

[75] Inventor: David Vonasek, Bothell, Wash.

[73] Assignee: Emcon, Inc., San Mateo, Calif.

[21] Appl. No.: 384,399

[22] Filed: Feb. 3, 1995

Related U.S. Application Data

[63] Continuation of Ser. No. 34,523, Mar. 22, 1993, abandoned.

[51] Int. Cl.[6] ..... F23D 14/00

[52] U.S. Cl. ..... 431/202; 431/4; 431/5; 110/238; 110/346; 110/348

[58] Field of Search ..... 431/202, 5, 4; 110/346, 348, 238

[56] References Cited

U.S. PATENT DOCUMENTS

| | | | |
|---|---|---|---|
| 3,852,023 | 12/1974 | Itoh et al. | 431/202 |
| 3,973,899 | 8/1976 | Reed et al. | 431/202 |
| 4,036,580 | 7/1977 | Reed et al. | 431/202 |
| 4,116,610 | 9/1978 | Berthiaune | 431/4 |
| 4,127,379 | 11/1978 | Grove | 431/4 |
| 4,245,979 | 1/1981 | Ito | 431/202 |
| 4,342,550 | 8/1982 | Tuck | 431/4 |
| 4,425,856 | 1/1984 | Szilagyi | 110/238 X |
| 4,610,622 | 9/1986 | Quinnell | 431/5 |
| 4,652,233 | 3/1987 | Hamazaki et al. | 431/202 |
| 4,694,756 | 9/1987 | Carrara | 110/238 |
| 4,838,184 | 6/1989 | Young et al. | 110/346 |
| 4,900,244 | 2/1990 | Keller et al. | 431/5 |
| 4,957,050 | 9/1990 | Ho | 110/346 |
| 5,008,098 | 4/1991 | Beradiner et al. | 423/659 |
| 5,044,326 | 9/1991 | Coerper et al. | 110/238 X |
| 5,097,774 | 3/1992 | Lauwers | 110/346 |
| 5,129,333 | 7/1992 | Fredrick et al. | 110/238 X |
| 5,129,335 | 7/1992 | Lauwers | 110/346 |
| 5,156,098 | 10/1992 | Camp | 110/238 |
| 5,170,727 | 12/1992 | Nielsen | 110/346 |
| 5,216,968 | 6/1993 | Capek et al. | 110/238 X |

*Primary Examiner*—Larry Jones
*Attorney, Agent, or Firm*—Paul L. Griffiths

[57] ABSTRACT

A method and apparatus for the on-site disposal of landfill gas (LFG) condensate is disclosed. Any contaminants in the condensate are incinerated in an LFG flare. The LFG condensate is first pressurized and then injected, in an atomized state, into a combustion zone of the LFG flare. The LFG condensate is pumped from a plurality of sumps to an accumulator. A pump controlled by a liquid level sensor cycles on and off in response to the level of condensate in the accumulator. The pressurized condensate is delivered to a nozzle via a conduit system. The pressurized condensate is atomized by the nozzle and the resulting mist is directed into the combustion zone where it is vaporized. Any contaminants in the condensate are incinerated along with similar contaminants in the LFG.

20 Claims, 1 Drawing Sheet

METHOD AND APPARATUS FOR DISPOSAL OF LANDFILL GAS CONDENSATE

This application is a continuation of Ser. No. 08/034,523, Mar. 22, 1993, now abandoned.

TECHNICAL FIELD

The present invention relates to the disposal of condensate formed in a landfill gas (LFG) collection system. In particular, the invention relates to the incineration of contaminants in LFG condensate within an LFG flare.

BACKGROUND ART

The majority of landfills create methane gases that escape into the surrounding atmosphere if they are uncontrolled. The gases have an obnoxious odor and can harm the environment in many ways. The Environmental Protection Agency (EPA) has recently released new solid waste regulations and a draft of New Source Performance Standards (NSPSs) which could significantly increases the number of landfills that are now required to employ active LFG collection systems. Landfill gas condensate is a by-product of these collection systems.

Landfill gases are produced within the refuse pile of a landfill as organic matter decomposes. If left alone, the gas may migrate within the landfill, ultimately escaping at the landfill's surface into the atmosphere. Under the new EPA regulations, LFG collection systems will be installed in currently active and previously closed landfills; as well as part of the procedure for closing a landfill. An LFG collection system generally includes a series of gas extraction wells. The wells are typically formed by drilling a hole into the refuse pile and inserting a perforated pipe into the hole. The space around the pipe is typically backfilled with a porous material to facilitate gas flow. The wells are connected together by a series of collector pipes. The collector pipes are connected to a fan which provides the necessary vacuum to extract the LFG from the refuse pile. The LFG is then fed into a flare which burns the gas.

The temperature of the gas within the refuse pile can achieve temperatures as high as 90° fahrenheit (F) to 140° F. depending on the type and moisture content of organic matter in the refuse pile, as well as the other site specific conditions. The amount of gas produced also depends on these factors and on the age of the landfill. Generally, a landfill will produce its maximum amount of gas between three and seven years after it is closed. When the gas being drawn up through the wells reaches the collector piping on the surface, it is cooled by the ambient temperature of the air. As the gas cools, condensation forms on the inside of the piping. The piping is pitched to allow the condensate to flow to a collection point or dump. If the piping system has a plurality of collection points, the condensate is pumped by conventional means to a central collection or accumulating tank.

Until now, the condensate formed in the gas collection piping was released back into the landfill. Under-the new Subtitle D Regulations for municipal solid waste facilities, landfill gas condensate must be collected unless the landfill gas collection system is operated within a landfill equipped with both composite base liner and leachate collection systems. The current methods of disposal include discharging the condensate into an on-site leachate treatment system or transporting the condensate to an industrial wastewater treatment facility. Only a limited number of landfills can make practical use of the aforementioned solutions. Many landfills, due either to their design or location, cannot economically use these solutions. Smaller landfills located in rural areas are in great need of an economical solution. An alternative solution for these and other landfills is needed.

It is an object of this invention to provide a method and apparatus for the onsite disposal of LFG condensate. It is a further object of the present invention to incinerate the contaminants in the LFG condensate by using the waste heat generated by burning LFG in an onsite flare.

SUMMARY OF THE INVENTION

A system constructed according to the present invention is capable of disposing of LFG condensate in an onsite LFG flare. The system includes a means for pressurizing the condensate for delivery to a nozzle which atomizes the condensate and directs the mist created into the combustion region of an LFG flare.

The nozzle is capable of withstanding repeated cycles of being alternately heated and then cooled. This is due to the fact that the system may only need to operate intermittently. The nozzle atomizes the LFG condensate into a fine mist such that large droplets are generally not formed. The nozzle is sized so as to prevent the mist created from impinging on the wall of the flare and to maximize the mist's residence time within the flare.

The condensate collection system includes an accumulator tank typically located near the flare facility. The LFG condensate generally accumulates at a rate less than the rate at which it can be burned off. A liquid level sensor is used to turn on a pump when the condensate reaches a desired level in the accumulator. The pump pressurizes the system and begins to draw down the liquid level in the accumulator. When the liquid level is lowered to a predetermined level, the pump is shut off.

A pressure relief valve protects the system from excessive pressure. The relief valve is in fluid communication with the accumulator via a recirculation pipe.

A flow control valve is used to ensure that a predetermined flow rate is maintained. A visual flow rate gage may be used to ensure that the proper flow rate is established. A filter is used to reduce the possibility of particulate matter clogging the nozzle. A pressure gage may be used to ensure that the required pressure is present after the filter. This gage can be used to determine when the filter needs to be cleaned or changed.

An injector assembly is used to inject the condensate at the proper location within the LFG flare. A shut-off valve is used to prevent condensate from leaking from the upstream piping while the injector assembly is serviced. The injector assembly includes a quick-disconnect fitting, a length of conduit and a nozzle. The conduit is configured such that the assembly can be withdrawn from the flare without the need to shut off the flare. This allows the nozzle to be cleaned or changed without effecting the operation of the flare. The nozzle atomizes the condensate into a mist that is directed into the flare's combustion zone.

In order to design the system, a method is used to determine the amount of excess heat available in a given LFG flare for use in disposing of the condensate. The method includes determining the amount of methane in the gas stream on a percentage basis. Using this value and a value of 1,000 BTU's per standard cubic foot of methane in combination with the gas flow rate to determine the total Btu's available. Based on the site-specific data for the amount of LFG collected and the flare's minimum operation requirements, the amount of the LFG's excess heat value (Btu/min) is determined. It is estimated that 24,000 BTU's are needed to vaporize a gallon of condensate and raise the vapor temperature to the required minimum temperature. The excess heat value divided by 24,00 BTU's per gallon yields the maximum theoretical injection rate of condensate for a given flare. A further step of injecting clean, potable water into the flare while monitoring the flare's operating temperature can be used to ensure that the proper destruction efficiency conditions are maintained within the flare.

BRIEF DESCRIPTION OF THE DRAWINGS

In the drawings, like reference numerals and numbers refer to like parts throughout the various views, and wherein.

BEST MODE FOR CARRYING OUT THE INVENTION

Figure 1:
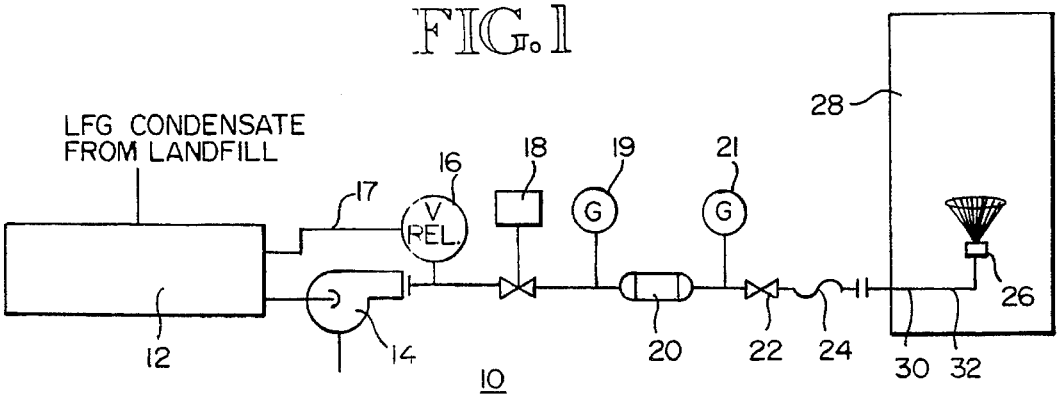
FIG. 1 is a schematic showing the major components of the system and their relationship to each other.

Referring now to FIG. 1, an LFG condensate burn-off system 10 is shown. The main components of the system include a condensate storage tank 12, a feed pump 14, a pressure relief valve 16, a flow metering valve 18, a filter 20, a gate valve 22, a quick disconnect fitting 24, and a nozzle 26. The nozzle 26 is located within an LFG flare 28.

Accumulator tank 12 accumulates and stores the LFG condensate as the condensate is pumped from various locations around the LFG collection system. A fluid level control system (not shown) cycles pump 14 on and off according to the level of condensate in the accumulator tank 12. Should the condensate injection system fail to turn on, a maximum high-level float switch within the accumulator tank 12 will shut-off the condensate collection system to prevent overflow of the accumulator tank 12. Feed pump 14 must be sized to handle an appropriate flow rate in relation to the maximum BTU rating of the flare 28. In a flare 28 having a maximum flow rate of 1500 CFM of LFG with a methane content of 55%, by volume, the system has a maximum theoretical throughput of 23.0 gallons per minute of condensate. Using a safety factor of 50%, a condensate liquid injection rate of up to 11.5 gallons per minute is possible. However, 11.5 GPM equals approximately 497,000 gallons per month when continuously fed, which exceeds the amount of condensate produced, for an equivalent amount of gas produced, in an LFG collection system. It is estimated that an LFG condensate collection system being used in conjunction with a flare rate of 1,500 CFM, would generate no more than 6,000 gallons per month of LFG condensate at a maximum condition. Therefore, at a condensate injection rate of one GPM, the system would operate for approximately 3⅓ hours per day. Therefore, for this situation the feed pump 14 need only be capable of delivering up to 2 GPM. In addition, the feed pump 14 must be capable of delivering the condensate in the range of 20–100 psi or more (60–100) actual range at the nozzle 26 at a pressure in the range of 20–120 psi, preferably in the range of 60–100 psi. This pressure is needed in order to insure the proper atomization of the condensate flowing out of nozzle 26.

The pressure relief valve 16 is fitted in a recirculation line 17 thereby preventing the over-pressurization of the system 10. The recirculation line 17 feeds any liquid passing through the relief valve 16 back into the accumulator tank 12.

A flow metering valve 18 may be used to more accurately control the flow rate of condensate. A flow rate gauge 19 may be used to visually check the flow rate. A filter 20 is used to insure that particles capable of clogging the nozzle 26 are trapped before reaching the nozzle. A pressure gauge 21 may be used to check the pressure drop across the filter 20 and to verify the required discharge pressure of the feed pump 14.

A shut-off valve 22 is used to close off the piping system such that quick disconnect joint 24 may be disconnected without loss of fluid from the system. The quick disconnect 24 is used to quickly disconnect an injector assembly 30 which includes nozzle 26. This arrangement is used in order to remove the injector assembly 30 from the flare 28 in order to service the nozzle 26 without shutting down the LFG flare. The nozzle 26 and flare 28 are more fully described below.

Figure 2:
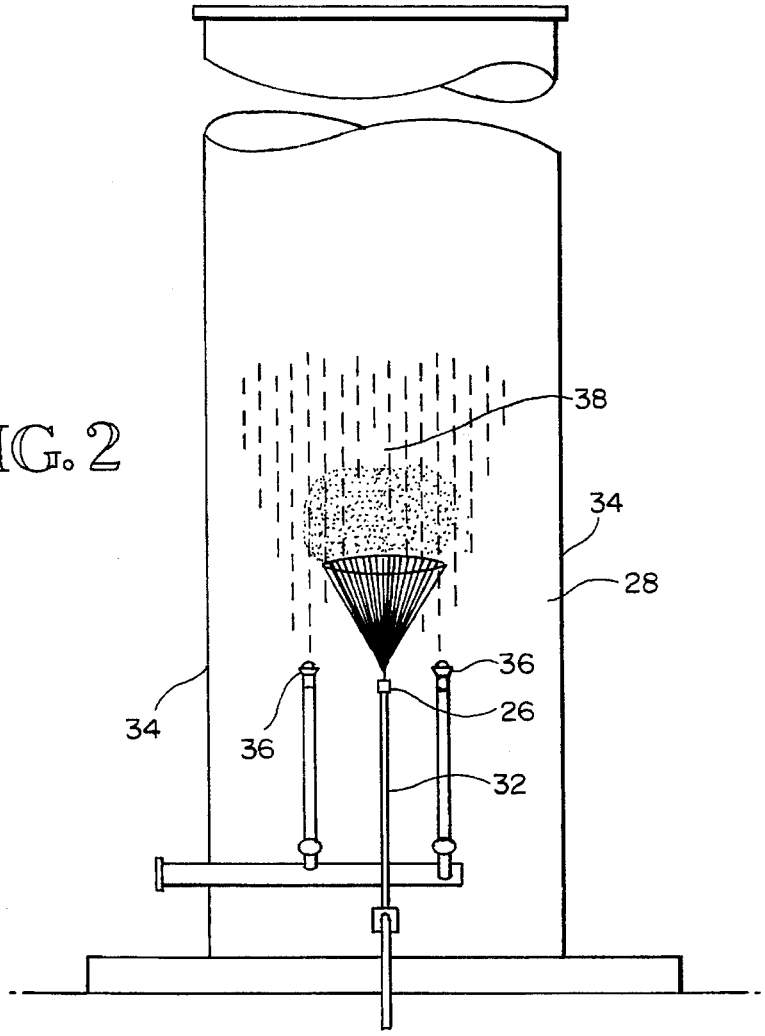
FIG. 2 is a sectional view of a landfill gas flare showing a plurality of burner heads and a landfill gas condensate nozzle.

The injector assembly 30 includes nozzle 26 and piping 32. The injector assembly is sized to handle the condensate flow discussed above. The nozzle 26 is a high pressure nozzle used to atomize the condensate to a fine mist having particles in the range of 1 to 1000 microns in diameter. There is an indication that a preferred range is 25 to 400 microns. As shown in FIG. 2, the nozzle 26 is located centrally within the flare 28. This reduces the chance of any atomized condensate particles impinging on the flare walls 34. Nozzle 26 is further located at a point in relation to flare burner heads 36 such that the nozzle is only exposed to temperatures up to 1,600° F. Generally, a temperature of over 3,000° F. may be reached in combustion zone 38. Zone 38 generally starts at or just above burner heads 36 and extends upward as much as 85% of the flare's height. When the atomized condensate is injected into the combustion zone 38 it instantaneously flashes into a gaseous vapor. At this point the condensate has returned to the landfill gas state from which it precipitated. The LFG and condensate vapor is then incinerated with a destruction efficiency for volatile organics of at least 99.9%.

A method for determining the maximum amount of LFG condensate that can be destroyed within a flare 28 is now described. United States Environmental Protection Agency (USEPA) is considering regulations which will require landfill gas disposal methods to achieve a minimum of 98% destruction efficiency for non-methane volatile organic compounds. A state-of-the-art LFG flare having an enclosed combustion area achieves incineration efficiency in excess of 99.9% for almost all trace volatile organic compounds (VOCs) typically found in LFG. In order to obtain these efficiencies the flare must be operated at temperatures in excess of 1400° F. An LFG flare generally requires at least 25% of the maximum design flow rate to maintain this temperature. The remaining 75% of the gas is burned as excess energy which is dissipated into the atmosphere. It is this excess heat which is used to incinerate the low volumes of LFG condensate generated during the typical operation of most LFG collection systems. LFG flare systems are generally rated by the volume of gas that they can handle. A 100 CFM LFG system can have a flare stack measuring 4 or 5 feet in diameter with a height of 20–25 feet, while a 4000 CFM flare would require a 12 foot diameter by 40 foot tall stack.

In order to achieve the high efficiency of destruction, the compounds being incinerated have a specific residence requirement, i.e., the amount of time at a given temperature that it must remain in order to assure its complete destruction. Therefore, the design and operation of an LFG flare must provide the necessary gas velocity that will subject the LFG to the minimum allowable temperature for the proper amount of time. The flare must generate the desired minimum temperature to achieve the autoignition temperatures required to destroy the VOCs within the LFG. Generally speaking, this is achieved by controlling the amount of combustion air entering the base of the flare. The operating temperature of a flare is measured by a thermocouple typically inserted into the stack just below the top of the flare. The flare must generate sufficient heat to provide the minimum temperature required for thermal destruction between the combustion zone and thermocouple location. As a result, a flare with a minimum 1,600° F. operating temperature measured at the thermocouple could have an actual combustion zone temperature of approximately 3,000° F. in the lower regions of the flare stack.

By way of example, a flare designed for a maximum flow rate of 1,500 CFM of LFG with a methane content of 55% by volume is used. Assuming a flow rate of 1,000 CFM of LFG having a methane content of 50% the following calculations can be made. Since pure methane has a heat content of approximately 1000 BTU's per cubic foot the total calculated energy potential entering the flare would be approximately 500,000 BTU's per minute (1000 CFM×50% $CH_4$×1000 BTU's/cubic foot). Approximately thirty-three (33%) of the heat rate (BTU's) is required to maintain the flare operating temperature which is dependent upon local regulatory requirements. This leaves approximately 335,000 BTU's per minute available for condensate incineration. It requires an estimated 24,000 BTU's to raise the temperature of a gallon of water with an ambient temperature of approximately 50° F. and convert it to a gaseous vapor, and then raise the vapor temperature to 1,600° F. Since the flare has 335,000 BTU's per minute of excess heat potential, with 24,000 BTU's per gallon of water required for thermal incineration, approximately 14.0 gallons per minute (GPM) of condensate theoretically could be injected into the flare and not effect the flare performance. As a safety factor 50% of the excess heat is assumed to be available for liquid destruction. Therefore, up to 7 GPM of condensate could be injected into the flare, without degrading its performance. It is estimated that up to approximately 4000 gallons per month of LFG condensates would be produced from a landfill gas collection system generating 1000 cubic feet per minute of LFG, although specific sites may generate more condensate on a percentage basis. This can vary according to the time of year, i.e., the ambient temperature and the amount of organic material available within the refuse pile. The estimated 4000 gallons per month of LFG condensate represents approximately 1% of the flare's liquid condensate destruction potential.

Having described the presently known best mode for carrying out the invention, it is to be understood that the LFG condensate burn-off system 10 described above and shown in the drawings could be altered in some ways without departing from what is considered to be the spirit and scope of the present invention.

I claim:

1. Apparatus for disposing of a condensate produced within a gas collection piping system of a landfill comprising;

means for atomizing said condensate, and means for introducing said atomized gas condensate into a single landfill gas flare, said flare having a cylindrical stack at least two feet in diameter and having an opening at its bottom to let in atmospheric air and open at the top for exhausting byproducts of combustion and having a generally circular burner nozzle located within said stack for burning landfill produced gas, said means for introducing said liquid condensate into said flare being located at a central location of said cylindrical stack and said circular burner nozzle whereby said condensate is vaporized and said contaminants are thermally destroyed.

2. An apparatus according to claim 1, wherein said means for atomizing includes means for pressurizing the condensate and then passing the pressurized condensate through a nozzle, and means mounting nozzle within said combustion zone.

3. An apparatus according to claim 1, wherein said means for atomizing said gas condensate includes;

means for pressurizing the condensate, a nozzle for atomizing the pressurized condensate, said nozzle dispersing the condensate into a fine mist, and means for positioning said nozzle within the combustion zone of a gas burner, said nozzle formed from a material capable of withstanding repeated heating and cooling cycles.

4. An apparatus according to claim 3, wherein said means for pressurizing the condensate includes pump means, a condensate accumulator, and a system of conduits connecting said accumulator and pump means.

5. An apparatus according to claim 4, wherein said system of conduits includes a condensate delivery assembly having a quick-disconnect coupling at one end and being connected to said nozzle at the other end thereof, whereby the nozzle can be removed from its position adjacent said gas burner without depressurizing said combustion system.

6. An apparatus according to claim 2, wherein said mounting means include a length of tubing connected to said nozzle such that said nozzle and tubing are readily removable from said position adjacent said gas burner.

7. An apparatus according to claim 3, wherein said nozzle disperses the condensate into a mist having droplets in a diameter range from 1 to 1000 microns.

8. An apparatus according to claim 1 wherein said means for atomizing said gas condensate disperses the condensate into a mist having droplets in a diameter range from 1 to 1000 microns.

9. An apparatus according to claim 3, wherein said nozzle is positioned in a central location on a horizontal plane within the combustion zone of a landfill gas flare, thereby reducing the possibility of any droplets in the mist impacting on the sidewall of the flare.

10. An apparatus for disposing of a gas condensate formed with a gas collection piping system on a landfill site comprising;

a means for pressurizing said gas condensate;

a nozzle capable of atomizing pressurized condensate, said nozzle dispersing the condensate into a fine mist and said nozzle positioned in a central position in a gas burner nozzle located within a landfill gas flare, said landfill gas flare having a cylindrical stack at least two feet in diameter and said gas burner nozzle is circular in configuration; and said nozzle formed from a material capable of withstanding repeated heating and cooling cycles.

11. An apparatus according to claim 10, where in said means for pressurizing the condensate includes a condensate accumulator, a system of conduits, and a pump.

12. An apparatus according to claim 11, wherein said system of conduits includes an injector assembly, said injector assembly includes a quick-disconnect coupling at one end and said nozzle at the other end, whereby the nozzle can be removed from its position adjacent said gas burner.

13. An apparatus according to claim 10, wherein said nozzle is mounted on a length of tubing such that said nozzle and tubing are readily removable from said position adjacent said gas burner.

14. An apparatus according to claim 10, wherein said nozzle disperses the condensate into a mist having droplets in a diameter range form 1 to 1000 microns.

15. An apparatus according to claim 10, wherein said nozzle is positioned in a central location on a horizontal plane within a landfill gas flare, thereby reducing the possibility of any droplets in the mist impacting on the sidewall of the flare.

16. A method for disposing of a gas condensate formed in a gas collection piping system of a landfill including the steps atomizing said condensate, and injecting said atomized condensate into a single combustion zone of a landfill gas flare, said flare having a cylindrical stack and a circular burner nozzle, to vaporize said condensate and thermally destroy any contaminants.

17. The method according to claim 16, wherein the step of atomizing said condensate includes the steps of;

pressurizing said condensate, and passing the pressurized condensate through a nozzle whereby the condensate is atomized to form a mist; said mist being injected into said combustion zone for vaporizing the condensate and incinerating contaminants.

18. The method according to claim 16 including the steps of;

collecting and storing the condensate formed in a landfill gas collection system, pressurizing and controlling the flow rate of the condensate through a conduit system, delivering the condensate to a nozzle located within a land fill gas flare, and dispersing the condensate through said nozzle thereby atomizing the condensate to form a mist, said condensate being injected into the combustion zone of the landfill gas flare.

19. The method of claim 16 wherein said condensate is atomized into a mist having droplets in a diameter range form 1 to 1000 microns.

20. The method of claim 16 wherein said condensate is atomized into a mist having droplets in a diameter range from 25–40 microns.

* * * * *